United States Patent [19]

Philipp

[11] Patent Number: 4,883,212

[45] Date of Patent: Nov. 28, 1989

[54] EXPLOSIVE POWDER CHARGE OPERATED SETTING DEVICE

[75] Inventor: Leo Philipp, Untervaz, Switzerland

[73] Assignee: Hilti Aktiengesellschaft, Fürstentum Liechtenstein, Fed. Rep. of Germany

[21] Appl. No.: 319,401

[22] Filed: Mar. 3, 1989

[30] Foreign Application Priority Data

Mar. 3, 1988 [DE] Fed. Rep. of Germany ..... 3806834

[51] Int. Cl.[4] ..... B25C 1/14

[52] U.S. Cl. ..... 227/9; 227/10

[58] Field of Search ..... 227/9, 10

[56] References Cited

U.S. PATENT DOCUMENTS 4,153,192 5/1979 Jochum ..... 227/10

4,382,533 5/1983 Buechel et al. ..... 227/10

4,595,134 6/1986 Jochum ..... 227/10 X

*Primary Examiner*—Donald R. Schran

*Assistant Examiner*—James L. Wolfe

*Attorney, Agent, or Firm*—Toren, McGeady

[57] ABSTRACT

An explosive powder charge operated setting device includes a housing, a barrel displaceably mounted within the housing, and a combustion chamber located in the rear end of the barrel. An outflow opening extends through the barrel transversely of its axial direction and is in flow communication with the combustion chamber. A slide, including a sealing piston, is displaceably positioned within the outflow opening the regulating the flow of explosive gases out of the combustion chamber. A handle is engaged with the slide for selectively positioning the sealing piston in the outflow opening.

6 Claims, 1 Drawing Sheet

EXPLOSIVE POWDER CHARGE OPERATED SETTING DEVICE

BACKGROUND OF THE INVENTION

The present invention is directed to an explosive powder charge operated setting device with a barrel containing a combustion chamber, an outflow opening through the barrel for explosive gases generated within the combustion chamber, and a regulating slide extending through the outflow opening for varying flow out of the barrel.

Various types of outflow regulators are known for use in explosive powder charge operated setting devices. Output regulators have been especially successful which enable a regulated outflow of the explosive gases from the barrel, so that when the outflow is reduced, less explosive gases or driving gases are carried away out of the barrel.

An output regulator operating in accordance with the above-described principle, is disclosed in DE-PS No. 27 09 065, however, it is relatively expensive.

SUMMARY OF THE INVENTION

Therefore, it is the primary object of the present invention to provide an output or outflow regulator which is simple in construction, easy to operate, and not susceptible to becoming fouled.

In accordance with the present invention, the output regulator is a regulating slide including a sealing piston for an outflow opening with the slide being displaceable parallel to the barrel axis.

By displacing the sealing piston parallel to the axis of the barrel, the cross-section of the outflow opening can be opened or closed in an infinitely variable manner. Preferably, the outflow opening is located in the rearward region of the barrel, in the form of an elongated hole, with the elongated hole being penetrated or traversed by a guide bore for the sealing piston with the sealing piston extending transversely of the radial direction of the outflow opening. Such an outflow regulator utilizing a sealing piston, displaceable in the above-described manner, has a particularly simple construction, since it requires no complicated working operations during the fabrication of the individual parts forming the setting device.

Using a sealing piston of the above-described type affords the possibility of avoiding fouling problems in a simple manner by forming the sealing piston with sharp-edged transitions at its sealing surfaces. Since cylindrically-shaped surfaces on the sealing piston act as sealing surfaces, the ends of the sealing surfaces at the end of the sealing piston, or at a transition location to a reduced diameter section, are formed as sharp-edged transitions. The axial displacement of the sealing piston moves the sharp-edged transitions along the path of the outflow channel affording a cleaning action by stripping or scraping off deposited residues o the explosive or driving gases. Preferably, the regulating slide incorporating the sealing piston has a thread connected to a handle. As a result, the handle can be formed as an adjustment wheel operable from the outside of the setting device, whereby the sealing piston can be accurately positioned by turning the adjustment wheel in threaded engagement with the slide. In dependence on the selection of the thread pitch, a sufficiently fine adjustment of the position of the sealing piston is possible, so that the output of the setting device can be proportioned to be sufficiently accurate.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

Figure 2:
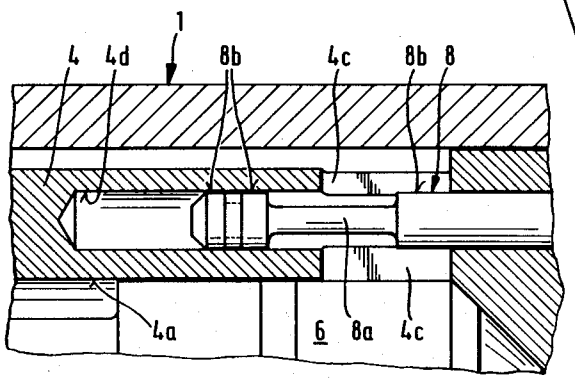
FIG. 2 is a partial sectional view of the encircled part II in FIG. 1, shown enlarged. DETAILED DESCRIPTION OF THE INVENTION In FIG. 1, an explosive powder charge operated setting device is illustrated, including a housing 1 with a handle 2, extending downwardly from the housing and containing a trigger 3 for actuating the device. An axially extending barrel with a front end muzzle part 5 is axially displaceably supported in the housing. Driving piston 6 is axially displaceable within the barrel bore 4*a*, and extends forwardly into the bore formed in the muzzle part 5. The rear end of the barrel bore 4*a*, rearwardly of the driving piston 6, forms a combustion chamber and cartridge support 4*b*. In the rearward housing part 1*a*, an axially extending ignition pin is supported aligned with the combustion chamber-cartridge support 4*b*, with the ignition pin 7 being actuatable in a known manner for igniting an explosive powder charge cartridge inserted into the combustion chamber-cartridge support. An outflow opening 4*c* extends radially outwardly from the barrel bore 4*a* adjacent the combustion chamber-cartridge support 4*b*. The outflow opening is in the form of an elongated hole extending through the wall of the barrel. Outflow opening 4*c* is penetrated by a bore 4*d* extending generally parallel to and spaced radially outwardly from the axis of the barrel. The bore 4*d* extends through the barrel and rearwardly an extension of the bore is provided in the rear part 1*a* of the housing. The diameter of the bore 4*d* projects outwardly from the width of the outflow opening.

A regulating slide is positioned in the bore 4*d* and the corresponding bore in the housing and includes a sealing piston 8, slidably displaceable within the housing and the barrel. Depending on the axial position of the sealing piston 8, the discharge cross-section of the outflow opening can be varied. As shown in greater detail in FIG. 2, sealing piston 8 has an axially extending section 8*a* of reduced diameter located, at least in part, within the axially extending range of the bore 4*d* in the barrel 4. The axial length of the section 8*a* corresponds to the axial length of the outflow opening 4*c*. Cylindrically-shaped sealing faces 8*d*, having a diameter corresponding to the diameter of the bore 4*d*, are located at the opposite ends of the section 8*a*. The edges of the sealing faces, forming a transition between the sealing faces and the reduced diameter in sections of the piston, are sharp-edged. Sealing piston 8 has a transverse pin 8*c* in the region located within the rear housing part 1*a* and the pin projects into an axially extending groove 1*b* located within the rear housing part 1*a*, and prevents rotation of the sealing piston 8, while permitting the piston to move in the axial direction. Rearwardly of the pin, the sealing piston 8 has a thread 8*d*. An adjustment wheel 9 is in threaded engagement with the thread 8*d* on the sealing piston 8 so that the adjustment wheel can be rotated about the piston effecting the axial movement of the piston. Adjustment wheel 9 has serrations 9*a* on its outer circumferential surface so that it can be more easily rotated.

Figure 1:
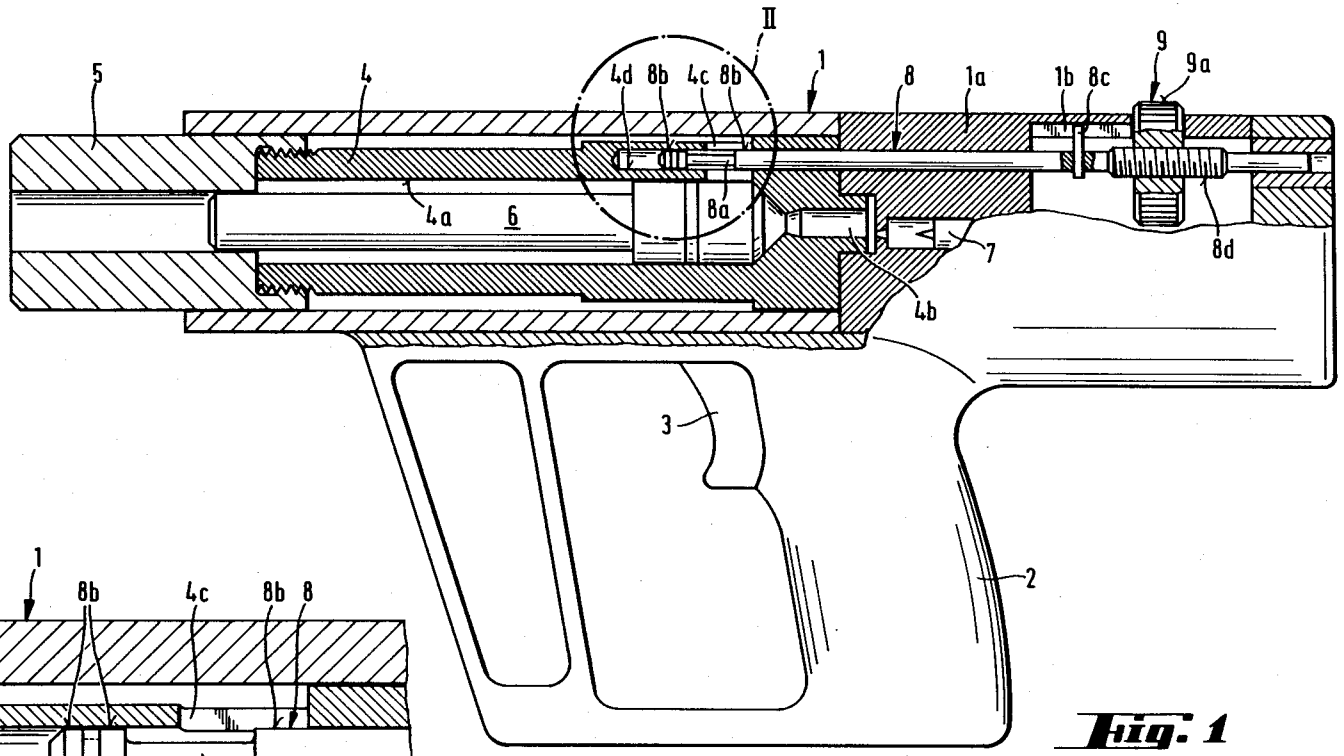
FIG. 1 is a side view, partly in axial section, of a setting device embodying the present invention.

By rotating the adjustment wheel 9, it is possible to regulate the output of the setting device. Depending on the manner in which the wheel is rotated, the sealing piston 8 is moved forwardly or rearwardly within the bore 4*d*, whereby the discharge cross-section of the outflow opening 4*c* is varied. Depending on the variable cross-section of the outflow opening, more or less of the explosive or driving gases can escape from the combustion chamber into the space between the outer surface of the barrel 4 and the housing 1, so that, in addition, noise abatement is obtained. After each setting operation effected by the setting device, the barrel is advanced in the forward direction for removing the spent cartridge shell and then it is returned into the position illustrated in FIG. 1 after a new cartridge has been inserted into the cartridge support 4*d*. During the movement of the barrel relative to the housing, the bore 4*d* moves relative to the sealing piston 8 and the sharp edged parts of the sealing faces 8*b* scrape any residue from the bore resulting from the driving gases. Accordingly, the regulating slide is able to function permanently.

While specific embodiments of the invention have been shown and described in detail to illustrate the application of the inventive principles, it will be understood that the invention may be embodied otherwise without departing from such principles.

I claim:

1. An explosive powder charge operated setting device comprises a housing, an axially extending barrel axially displaceably mounted in said housing, said barrel having a front end and a rear end with a cartridge chamber in the rear end of the barrel, an outflow opening having a flow cross-section extending through said barrel and communicating with the cartridge chamber for flowing explosive gases outwardly from the barrel, a slide for regulating the flow cross-section of said outflow opening, wherein the improvement comprises an axially extending bore located at least in part within said barrel and extending parallel to the axis of said barrel, said bore traversing said outflow opening, said slide being movably displaceable in said bore, said slide including a sealing piston located at least in the range of said outflow opening, and means engaging said slide for slidably displacing said sealing piston within said bore.

2. An explosive powder charge operated setting device, as set forth in claim 1, wherein said sealing piston has axially and circumferentially extending sealing surfaces and reduced diameter surfaces adjacent said sealing surfaces with said sealing surfaces forming sharp-edged transitions to the reduced diameter surfaces.

3. An explosive powder charge operated setting device, as set forth in claim 2, wherein said sealing piston has an axially extending thread thereon spaced axially from said sealing surfaces, and said means comprises a handle in threaded engagement with said thread, and means for securing said sealing piston against rotation for effecting axial displacement of said sealing piston by manipulation of said handle.

4. An explosive powder charge operated setting device, as set forth in claim 3, wherein said handle is an adjustment wheel encircling said sealing piston and projecting outwardly from the housing for effecting axial adjustment of said sealing piston from the exterior of said setting device.

5. An explosive powder charge operated setting device, as set forth in claim 2, wherein at least two said sealing surfaces are formed on said sealing piston, spaced apart by an axially extending reduced diameter section.

6. An explosive powder charge operated setting device, as set forth in claim 5, wherein said barrel being axially movable relative to said sealing piston so that said sealing piston traverses said outflow opening, whereby the sharp-edged transitions on said sealing piston scrape said bore in the region of said outflow opening.

* * * * *